US006609531B2

(12) United States Patent
Lesko

(10) Patent No.: US 6,609,531 B2
(45) Date of Patent: Aug. 26, 2003

(54) CONDENSER TUBE CLEANING NOZZLE

(76) Inventor: Edward R. Lesko, 58 Donna Dr., Plymouth, MA (US) 02360

( * ) Notice: Subject to any disclaimer, the term of this patent is extended or adjusted under 35 U.S.C. 154(b) by 96 days.

(21) Appl. No.: 09/960,676

(22) Filed: Sep. 24, 2001

(65) Prior Publication Data

US 2003/0056816 A1 Mar. 27, 2003

(51) Int. Cl.[7] ..... B08B 9/032

(52) U.S. Cl. ..... 134/169 C; 15/317; 122/379; 165/95; 451/76

(58) Field of Search ..... 134/166 C, 167 C, 134/168 C, 169 C; 15/317, 104.05; 451/76, 102; 165/95; 122/379, 391, 392

(56) References Cited

U.S. PATENT DOCUMENTS 1,867,751 A 7/1932 Oberhuber
1,985,813 A * 12/1934 Baden ..... 134/166 C
3,789,861 A 2/1974 Conn et al.
4,137,928 A 2/1979 Sentell
4,467,488 A 8/1984 Creek
4,643,248 A 2/1987 Voith et al.
5,305,488 A 4/1994 Lyle
5,426,807 A 6/1995 Grimsley et al.
5,437,073 A 8/1995 Smith
5,448,795 A 9/1995 Boughal
5,885,133 A 3/1999 Williams, Jr.

* cited by examiner

*Primary Examiner*—Philip R. Coe
(74) *Attorney, Agent, or Firm*—John P. McGonagle

(57) ABSTRACT

A condenser tube cleaning nozzle which is cushioned with resilient washers. The present invention provides a stiffened nozzle adapted to handling high pressure, while at the same time providing cushioning at all contact points on a tube sheet and within a particular tube being cleaned.

5 Claims, 4 Drawing Sheets

FIG. 1
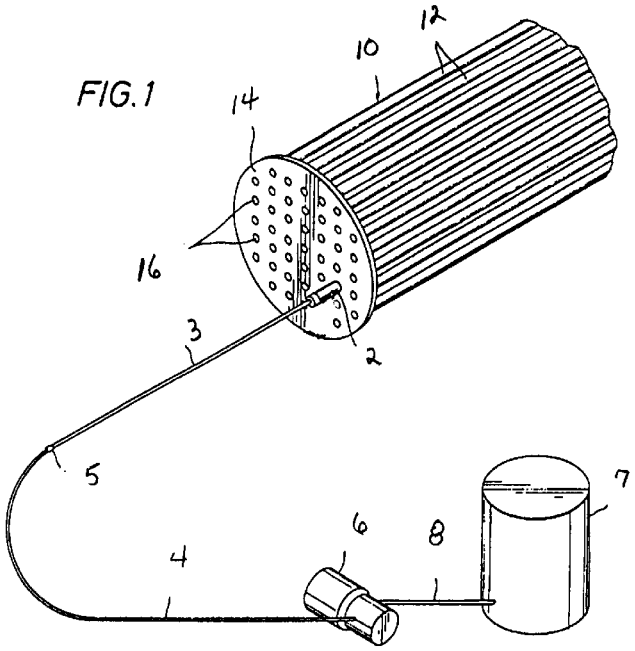
FIG. 2B
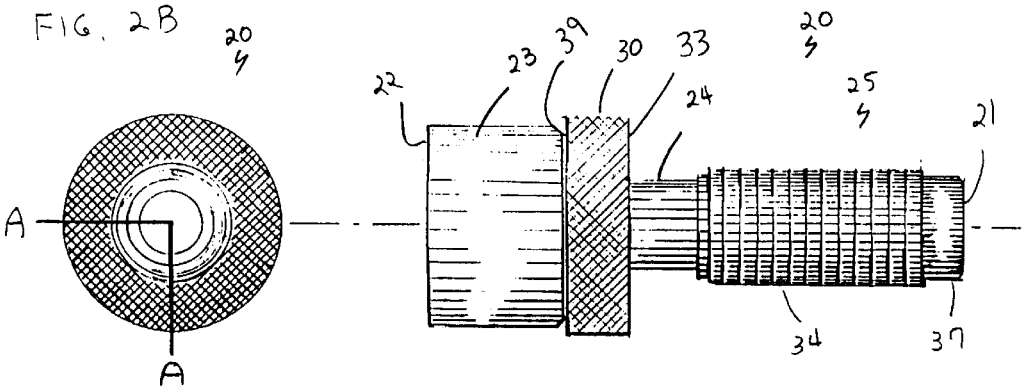
FIG. 2A

CONDENSER TUBE CLEANING NOZZLE

BACKGROUND OF THE INVENTION

This invention relates to an apparatus for cleaning a tubular member, and in particular, to a cleaning nozzle for a condenser tube.

This invention will generally be described in connection with tube cleaners for heat exchanger and condenser tubes. However, it is to be appreciated that the invention has application to a wide variety of tubes and that the scope of the invention is not limited to such cleaners.

Heat exchangers and condensers often contain a large number of metal tubes through which heat exchanging fluid flows. The tubes are usually arrayed in parallelism and are supported adjacent their ends by transverse tube sheets. Over time, the tube sheets become heavily pitted, corroded or worn away, thus weakening the entire structure. To prevent this, various coatings are applied to the tube sheets, thereby preventing or substantially retarding pitting, corrosion and wear on the tube sheets.

It is well known that the operating efficiency of heat exchangers and condensers is reduced and fluid flow is restricted when the condenser tubes become fouled by such deposits as scale, algae, mud, slime and the like. In addition, if the tubes are not cleaned regularly, deposits may cause pitting or corrosion of the tubes, resulting in major damage and shortened tube life.

The interior of tube members such as a heat exchanger tube are generally cleaned by forcing a pressurized cleaning medium, e.g., pressurized gas/particulate solid mixture, water, water/solid slurry, etc., through the tubular member. In the prior art, tube cleaning generally involved the insertion of brass nozzles into a tube and subjecting the tube interior to high pressure from compressed air or water. However, it has been determined that the use of metallic nozzles damages the tube sheet coatings about the tube end. As a result, the prior art now generally uses nylon nozzles. However, this still puts pressure on the coating about the tube ends and damaging the coating. Because nylon nozzles are soft, they do not work well under high pressure uses.

All existing tube cleaning nozzles are conical in shape and made from metal of plastic. The existing nozzles contact the tube sheet coating when placed in the tube. This contact frequently results in damage to the tube sheet coating.

SUMMARY OF THE INVENTION

The present invention addresses the limitations of prior art devices by providing a nozzle which is cushioned with soft washers. The present invention provides a stiffened nozzle adapted to handling high pressure, while at the same time providing cushioning at all contact points on the tube sheet and within the tube being cleaned.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

FIG. 1 is a perspective representation of a typical tube bundle of a heat exchanger with a cleaning system attached.

FIG. 2A is a side elevational view of a nozzle constructed according to the principles of the present invention.

FIG. 2B is a rear view of the nozzle of FIG. 2A.

DETAILED DESCRIPTION OF INVENTION

Figure 3:
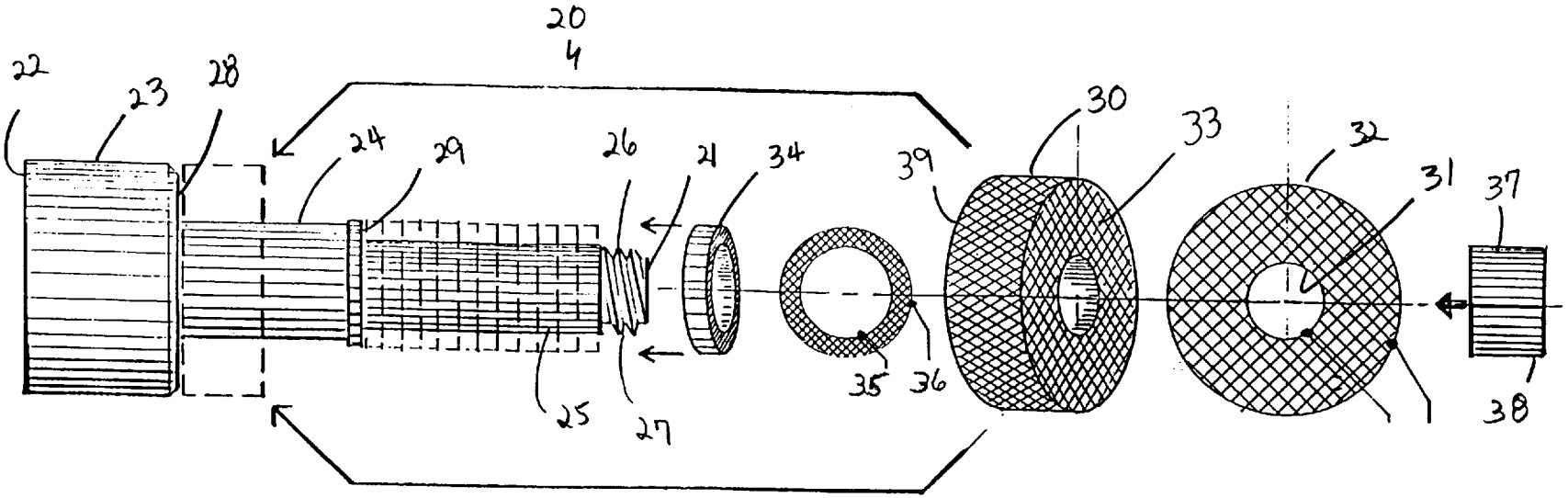
FIG. 3 is a side view, partly exploded, of the nozzle of FIG. 2A.
Figure 4:
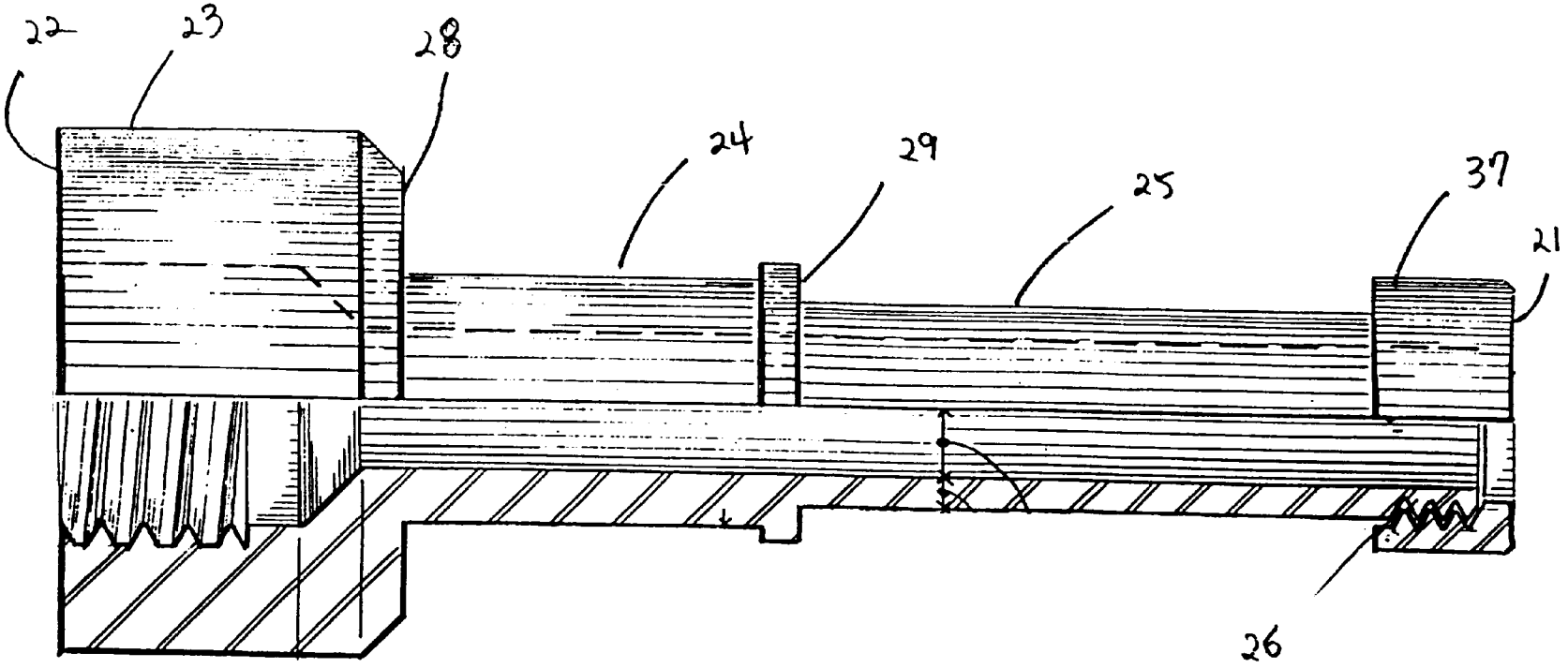
FIG. 4 is a sectional view of the invention nozzle along the section lines A—A of FIG. 2B.

Referring to the drawings in detail wherein like elements are indicated by like numerals, there is shown in FIG. 1 a typical heat exchanger bundle 10 comprising a plurality of parallel tubes 12, each tube 12 having an interior wall 13. The heat exchanger bundle 10 includes a coated transverse tube sheet 14 having a series of apertures 16 that provide entrances into and support of the tubes 12. A nozzle 2 is shown partially inserted into one of the tubes 12. The nozzle 2 is connected to a conveying conduit 3 that in turn is connected to a hose 4 by a suitable coupling 5, the hose 4 being connected to the output of a pump 6 that draws and pressurizes a liquid or gaseous medium from a tank 7 via line 8.

Referring to the drawings and particularly FIGS. 2A, 2B, 3–4, there is shown a nozzle 20 constructed according to the principles of the present invention. The invention nozzle 20 has a generally hollow, cylindrical shape with a distal end 21 and a proximal end 22, said ends 21, 22 defining the central, longitudinal axis of the nozzle 20. The nozzle 20 may be segmented longitudinally into three sections, a rearward section 23 beginning at the proximal end 22 and extending forwardly a specific distance toward the distal end 21, a middle section 24 extending forwardly a specific distance from the rearward section 23 toward the distal end 21, and a forward section 25 extending forwardly a specific distance from the middle section 24 and ending at the distal end 21. The diameter of the rearward section 23 is larger than the diameters of the middle section 24 and forward section 25. The diameter of the middle section 24 is larger than the diameter of the forward section 25. The foremost portion 26 of the forward section 25 is threaded about its outer surface 27. The rearward, middle and forward sections 23, 24, 25 may be made from metal or plastic.

A soft washer 30, having a forward end 33, a rearward end 39 and an inner diameter 31 slightly greater than the outer diameter of the middle section 24, is fitted over the middle section 24 with the soft washer rearward end 39 against the forward end wall 28 of the rearward section 23. The soft washer outer diameter 32 is approximately equal to the outer diameter of the rearward section 23. A plurality of identical rubber washers 34, typically made from neoprene, each having an inner diameter 35 slightly greater than the outer diameter of the forward section 25 are fitted over the forward section 25 and packed against the forward end wall 29 of the middle section 24. The outer diameter 36 of each rubber washer 34 is slightly greater than the outer diameter of the middle section 24. A threaded end cap 37 with an outer diameter 38 approximately equal to the outer diameter of the middle section 24 is threadingly engaged to the forward section foremost portion 26.

Figure 5:
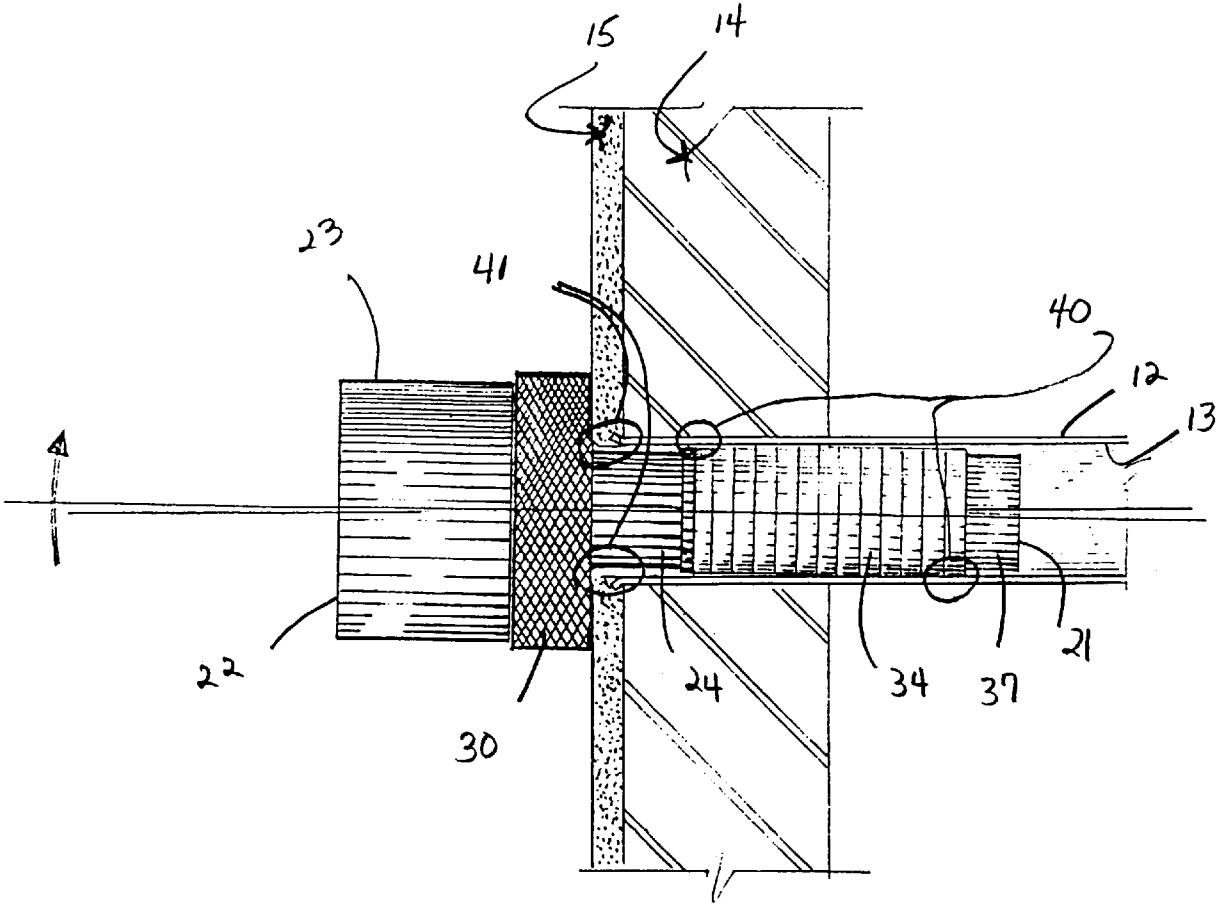
FIG. 5 is a view of the invention nozzle inserted into a tube within a tube bundle.

Referring again to the drawings and particularly FIG. 5, the nozzle distal end 21 is inserted into a tube 12 to be cleaned. The nozzle forward section 25 and a substantial portion of the middle section 24 is positioned within the tube 12. The soft washer outer diameter 32 is too great to fit into the tube 12 and the washer's forward end 33 abuts and rests against the coating 15 on the tube sheet 14. Because the nozzle end cap outer diameter 38 and outer diameter of the middle section 24 are less than the rubber washer outer diameters 36, only the rubber washers 34 have contact with the tube interior wall 13. When high pressure water and/or air is released through the nozzle into the tube 12, the friction of the rubber washers 34 against the tube interior wall 13 provides resistance to the nozzle 20 being pushed back out of the tube 12 by the water and/or air pressure. By making the rubber washer outer diameters 32 slightly less than the inner diameter of the tube interior wall 13, a "cocking" and "levering" effect is created with the nozzle. This creates additional friction at pressure points 40 between the tube interior wall 13 and the nozzle 20, and also seals the tube 12 from back pressure. The soft washer 30 positions the nozzle 20, prevents metal from contacting the tube sheet coating 15 at normal contact points 41, and absorbs and deflects any escaping back pressure to the cleaning nozzle operator.

It is understood that the above-described embodiment is merely illustrative of the application. The invention nozzle 20 is adapted to be attached to commonly used tube cleaning guns available in the prior art. Other embodiments of the invention may be readily devised by those skilled in the art which will embody the principles of the invention and fall within the spirit and scope thereof.

I claim:

1. A condenser tube cleaning nozzle for use with a heat exchanger bundle having a plurality of hollow parallel tubes, each said tube having an interior wall defining a tube interior and defining an interior diameter, said heat exchanger bundle including a coated transverse tube sheet having a series of apertures adapted to provide entrances into and support of the tubes, comprising:

a nozzle connected to a conveying conduit connected to a hose, said hose being connected to a pump, said pump adapted to draw and pressurizes a liquid or gaseous medium from a tank, said nozzle having a generally hollow, cylindrical shape, an outer surface, a distal end and a proximal end, said ends defining a central, longitudinal nozzle axis of the nozzle, said nozzle being segmented longitudinally into three sections, a rearward section beginning at the proximal end and extending forwardly a predetermined distance toward the distal end, a middle section extending forwardly a predetermined distance from the rearward section toward the distal end, and a forward section extending forwardly a predetermined distance from the middle section and ending at the distal end, said rearward section having an outer diameter larger than a middle section outer diameter and a forward section outer diameter, said middle section outer diameter being larger than the outer diameter of the forward section, said forward section having a foremost portion with a threaded outer surface;

a soft washer having a forward end, a rearward end and an inner diameter slightly greater than the outer diameter of the nozzle middle section, said soft washer being fitted over the nozzle middle section nozzle outer surface with the soft washer rearward end abutting a forward end wall of the nozzle rearward section, said soft washer having an outer diameter approximately equal to the outer diameter of the nozzle rearward section; and a plurality of resilient washers, each said resilient washer having an inner diameter slightly greater than the outer diameter of the nozzle forward section, said washers being fitted over the nozzle forward section outer surface and packed against a forward end wall of the nozzle middle section, said resilient washers each having an outer diameter greater than an nozzle end cap outer diameter and the outer diameter of the middle section;

a threaded end cap with an outer diameter approximately equal to the outer diameter of the middle section threadingly engaged to the forward section foremost portion.

2. A nozzle as recited in claim 1, wherein:

said nozzle distal end is adapted for insertion into the entrance of a tube to be cleaned, said nozzle forward section and a substantial portion of the middle section adapted to being positioned within the tube;

said soft washer outer diameter is greater than the tube inner diameter and said soft washer forward end abuts and rests against the coated tube sheet; and said resilient washers have outer diameters slightly less than the interior diameter of a tube.

3. A nozzle as recited in claim 2, wherein:

said resilient washers are adapted to frictionally engage said tube interior.

4. A nozzle as recited in claim 3, wherein:

said resilient washers are rubber washers.

5. A nozzle as recited in claim 4, wherein:

said rubber washers are made with neoprene.

* * * * *